US005562994A

United States Patent [19]

Abba et al.

[11] Patent Number: 5,562,994

[45] Date of Patent: Oct. 8, 1996

[54] UN-COATED PAPER-MAKING SLUDGE SUBSTRATE FOR METALLIZING

[75] Inventors: William A. Abba; Laurine A. Charles, both of Neenah, Wis.; Bernard Cohen, Berkeley Lake, Ga.

[73] Assignee: Kimberly-Clark Corporation, Neenah, Wis.

[21] Appl. No.: 309,817

[22] Filed: Sep. 21, 1994

[51] Int. Cl.[6] ..... B32B 9/00

[52] U.S. Cl. ..... 428/464; 428/211; 428/333; 428/457; 428/537.5

[58] Field of Search ..... 428/461, 537.5, 428/464, 211, 333, 327, 209, 457, 195, 458, 283

[56] References Cited

U.S. PATENT DOCUMENTS

| | | | |
|---|---|---|---|
| 3,158,506 | 11/1964 | Ellison | 428/464 |
| 3,265,524 | 8/1966 | Echeagaray | 428/464 |
| 3,561,598 | 2/1971 | Goldberg | 210/10 |
| 3,674,619 | 10/1972 | Scher | 428/464 |
| 3,769,116 | 10/1973 | Champeau | 156/62.8 |
| 3,833,468 | 9/1974 | Boniface | 162/264 |
| 3,884,755 | 5/1975 | Frost, III | 162/190 |
| 4,082,594 | 4/1978 | Stonehouse | 156/253 |
| 4,177,310 | 12/1979 | Steeves | 428/216 |
| 4,250,209 | 2/1981 | de Leeuw | 428/211 |
| 4,363,851 | 12/1982 | Mishing | 428/333 |
| 4,434,259 | 2/1984 | Gold et al. | 524/31 |
| 4,567,098 | 1/1986 | Becker | 428/327 |
| 4,599,275 | 7/1986 | Hayashi | 428/461 |
| 4,772,504 | 9/1988 | Andresen | 428/96 |
| 4,929,470 | 5/1990 | Rittenhouse | 428/537.5 |
| 4,983,258 | 1/1991 | Maxham | 162/189 |
| 5,002,633 | 3/1991 | Maxham | 162/5 |
| 5,047,286 | 9/1991 | Kaburaki et al. | 428/246 |
| 5,137,599 | 8/1992 | Maxham | 162/5 |

FOREIGN PATENT DOCUMENTS

| | | |
|---|---|---|
| 51-67403 | 6/1976 | Japan . |
| 2-221497 | 9/1990 | Japan . |
| WO95/10489 | 4/1995 | WIPO . |

OTHER PUBLICATIONS

Encyclopedia of Chem. Tech. 3rd ed. vol. 16, Wiley & Sons (1981) pp. 768–789.

*Primary Examiner*—Patrick Ryan
*Assistant Examiner*—Patrick Jewik
*Attorney, Agent, or Firm*—Karl V. Sidor

[57] ABSTRACT

An un-coated paper-making sludge substrate for metallizing, the substrate containing: 1) from about 40 to about 94 percent, by weight, low-average fiber length pulp, and 2) from about 6 to about 60 percent, by weight, ash generating materials, such that the paper-making sludge substrate is adapted, upon depositing a metallic coating onto a surface of the substrate, to provide a metallized paper with at least one surface having a gloss of at least about 19. Also disclosed is a metallized paper composed of: 1) a paper-making sludge substrate having a first surface and second surface, the paper-making sludge substrate containing from about 40 to about 94 percent, by weight, low-average fiber length pulp, and from about 6 to about 60 percent, by weight, ash generating materials, the paper-making sludge substrate being free of base coatings; and 2) a metallic coating on at least one surface of the substrate, so that at least one surface of the metallized paper has a gloss of at least about 19.

20 Claims, 4 Drawing Sheets

UN-COATED PAPER-MAKING SLUDGE SUBSTRATE FOR METALLIZING

FIELD OF THE INVENTION

This invention relates to paper-making sludge and a use for this by-product of paper-making processes.

BACKGROUND OF THE INVENTION

Sludge is a by-product of paper-making processes which has relatively limited uses and can present difficult and sometimes costly disposal problems. Recycled paper tends to contain more sludge-forming components than conventional virgin fiber sources. Substantial growth in the use of recycled paper has generally increased the amount of sludge generated.

In the past, sludge has typically been burned or buried. Those alternatives may pose environmental risks and can be relatively expensive. Some attempts have been made to incorporate small portions of sludge into papers made out of more conventional paper-making pulps. These efforts may be suitable for sludge material which is somewhat fiber-like and contains relatively low levels of ash-generating materials (e.g., clays, fillers, dirt and the like). Paper-making sludge which contains relatively high levels of ash-generating materials can present special problems.

Thus, there is a need to find a practical use for paper-making sludge which contains relatively high levels of ash-generating materials. A need exists for a practical process for converting paper-making sludge into a useful material or component of a product. There is also a need for a material or component of product which is made from or contains a substantial amount of paper-making sludge, especially a material or component made from or containing paper-making sludge that has relatively high levels of ash-generating materials.

DEFINITIONS

The term "average fiber length" as used herein refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i * n_i)/n$$

where k=maximum fiber length $x_i$=fiber length $n_i$=number of fibers having length $x_i$ n=total number of fibers measured.

The term "low-average fiber length pulp" as used herein refers to pulp and by-products of paper-making processes that contains a significant amount of short fibers and non-fiber particles. In many cases, these material may be difficult to form into paper sheets and may yield relatively tight, impermeable paper sheets or nonwoven webs. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.6 to 1.2 mm. Generally speaking, most of the fibrous or cellulosic components of paper-making sludge may be considered low average fiber length pulps (short fibers and non-fiber particles).

The term "high-average fiber length pulp" as used herein refers to pulp that contains a relatively small amount of short fibers and non-fiber particles which may yield relatively open, permeable paper sheets or nonwoven webs that are desirable in applications where absorbency and rapid fluid intake are important. High-average fiber length pulp is typically formed from non-secondary (i.e., virgin) fibers. Secondary fiber pulp which has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps which are wood fiber pulps include, for example, bleached and unbleached virgin softwood fiber pulps.

The term "pulp" as used herein refers to cellulose containing fibers from natural sources such as woody and non-woody plants. Woody plants include, for example, deciduous and coniferous trees. Non-woody plants include, for example, cotton, flax, esparto grass, milkweed, straw, jute hemp, and bagasse.

The term "permeability" as used herein refers to the ability of a fluid, such as, for example, a gas to pass through a material. Permeability may be expressed in units of volume per unit time per unit area, for example, (cubic feet per minute) per square foot of material (e.g., ($ft^3$/minute/$ft^2$) or (cfm/$ft^2$)).

The term "ash generating materials" as used herein refers to components of a paper which generate inorganic residue which remains after igniting a specimen of wood, pulp, or paper so as to remove combustible and volatile compounds. The term "paper-making sludge" as used herein refers to residue from conventional paper-making processes that contains a substantial proportion of both low-average fiber length pulp (i.e., short fibers and non-fiber particles) and ash-generating materials. The fibrous or cellulosic component of paper-making sludge may contain more than 70 percent, by weight, low-average fiber length pulp. For example, the fibrous or cellulosic component of paper-making sludge may contain more than 80 percent, by weight, low-average fiber length pulp. In many cases, the fibrous or cellulosic component may be low-average fiber length pulp containing more than 40 percent "fines" (i.e., fiber-like particles of about 0.4 mm or less in length) as determined by an optical fiber analyzer such as, for example, a Kajaani fiber analyzer model No. FS-100 (Kajaani Oy Electronics, Kajaani, Finland). For example, the fibrous or cellulosic component may be low-average fiber length pulp containing more than 50 percent "fines". The ash-generating portion of paper-making sludge generally makes up at least 6 percent or more of the sludge (as determined by conventional techniques for measuring levels of such materials). For example, the ash-generating portion of paper-making sludge generally may make up from about 15 percent or more of the sludge.

SUMMARY OF THE INVENTION

The present invention addresses the above described problems by providing an un-coated paper-making sludge substrate for metallizing, the substrate containing: 1) from about 40 to about 94 percent, by weight, low-average fiber length pulp; and 2) from about 6 to about 60 percent, by weight, ash generating materials, such that the paper-making sludge substrate is adapted, upon depositing a metallic coating onto a surface of the substrate, to provide a metallized paper with at least one surface having a gloss of at least about 19. For example, the un-coated paper-making sludge substrate is adapted, upon deposition of a metallic coating, to provide a metallized paper with at least one surface having a gloss of at least about 20.

In an aspect of the invention, the un-coated paper-making sludge substrate may be adapted, upon deposition of a metallic coating, to provide a metallized paper with at least one surface having a gloss at least about 10 percent greater than a metallized un-coated paper (e.g., substrate) composed substantially of pulp fibers (e.g., either low-average fiber length pulp or high-high fiber length pulp) having an ash-generating material content of less than 6 percent and having an identical metallic coating. For example, the un-coated paper-making sludge substrate may be adapted, upon deposition of a metallic coating, to provide a metallized paper with at least one surface having a gloss at least about 15 percent greater than a metallized un-coated paper composed substantially of pulp fibers (e.g., either low-average fiber length pulp or high-high fiber length pulp) having an ash-generating material content of less than 6 percent and having an identical metallic coating.

According to the present invention, the un-coated paper-making sludge substrate may be composed of from about 50 to about 85 percent, by weight, low-average fiber length pulp, and from about 15 to about 50 percent, by weight, ash generating materials. The low average fiber length pulp may have an average fiber length ranging from about 0.6 to 1.2 mm.

In an embodiment of the invention, the un-coated paper-making sludge substrate may have at least one surface having a Parker Print-Surf smoothness value of less than about 4.75 microns (μm). For example, at least one surface of the uncoated paper-making sludge substrate may have a Parker Print-Surf smoothness value of less than about 4.25 microns. As a further example, the un-coated paper-making sludge substrate may have at least one surface having a Parker Print-Surf smoothness value of less than about 3.75 microns.

In one embodiment of the invention, there is provided an un-coated paper-making sludge substrate for metallizing having a first surface and a second surface, the paper-making sludge substrate being composed of: from about 60 to about 90 percent, by weight, low-average fiber length pulp; and from about 10 to about 40 percent, by weight, ash generating materials, such that the paper-making sludge substrate has at least one surface having a Parker Print-Surf smoothness value of less than about 4.75 microns and is adapted, upon depositing a metallic coating onto a surface of the substrate, to provide a metallized paper with at least one surface having a gloss of at least about 19. In one example, the un-coated paper-making sludge substrate may contain from about 70 to about 85 percent, by weight, low-average fiber length pulp, and from about 15 to about 30 percent, by weight, ash generating materials.

Desirably, the un-coated paper-making sludge substrate may have at least one surface having a Parker Print-Surf smoothness value of less than about 4.25 microns. More desirably, the un-coated paper-making sludge substrate may have at least one surface having a Parker Print-Surf smoothness value of less than about 3.75 microns. It is also desirable that the un-coated paper-making sludge substrate is adapted, upon deposition of a metallic coating, to provide a metallized paper with at least one surface having a gloss of at least about 20. In the present invention, it is further considered desirable that the un-coated paper-making sludge substrate is adapted, upon deposition of a metallic coating, to provide a metallized paper with at least one surface having a gloss at least about 10 percent greater than a metallized un-coated paper-making sludge composed substantially of pulp fibers (e.g., either low-average fiber length pulp or high-high fiber length pulp) having an ash-generating material content of less than 6 percent and having an identical metallic coating. More desirably, the un-coated paper-making sludge substrate may be adapted, upon deposition of a metallic coating, to provide a metallized paper with at least one surface having a gloss at least about 15 percent greater than a metallized un-coated paper composed substantially of pulp fibers (e.g., either low-average fiber length pulp or high-high fiber length pulp) having an ash-generating material content of less than 6 percent and having an identical metallic coating. The present invention encompasses a metallized paper product composed of a paper-making substrate as described above and a metallic coating.

The present invention encompasses a metallized paper composed of: 1) a paper-making sludge substrate having a first surface and second surface, the paper-making sludge substrate containing from about 40 to about 94 percent, by weight, low-average fiber length pulp, and from about 6 to about 60 percent, by weight, ash generating materials, the paper-making sludge substrate being free of base coatings; and 2) a metallic coating on at least one surface of the substrate, so that at least one surface of the metallized paper has a gloss of at least about 19. Desirably, at least one surface of the metallized paper has a gloss of at least about 20.

In an aspect of the present invention, at least one surface of the metallized paper has a gloss at least about 10 percent greater than a metallized un-coated paper composed substantially of pulp fibers (e.g., either low-average fiber length pulp or high-high fiber length pulp) having an ash-generating material content of less than 6 percent and an identical metallic coating. For example, at least one surface of the metallized paper has a gloss at least about 30 percent greater than a metallized un-coated paper composed substantially of pulp fibers (e.g., either low-average fiber length pulp or high-high fiber length pulp) having an ash-generating material content of less than 6 percent and an identical metallic coating.

The present invention encompasses a multilayer material composed of at least two layers of the metallized paper described above. The present invention also encompasses a multilayer material comprising at least one layer of the metallized paper described above and at least one other layer. The other layer may be selected from papers, films, woven fabrics, knit fabrics, bonded carded webs, continuous spunbond filament webs, meltblown fiber webs, and combinations thereof.

DETAILED DESCRIPTION OF THE INVENTION

Figure 1:
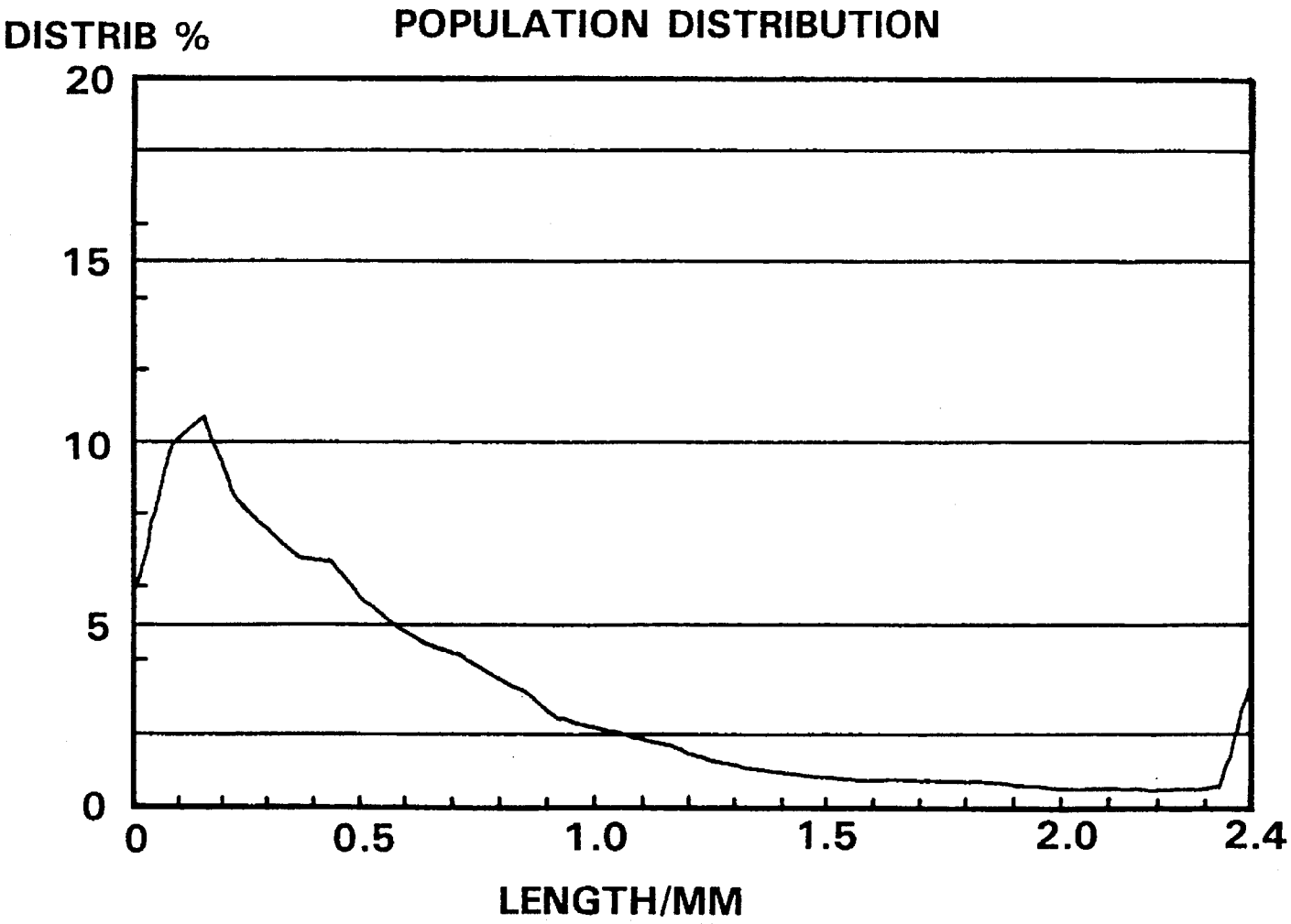
FIG. 1 is an illustration of a fiber population distribution for an for an exemplary paper-making sludge.

According to the present invention, paper-making sludge can be formed into a paper-making sludge substrate that can be metallized into a metallized paper. The paper-making sludge can be sludge having a relatively high proportion of ash-generating materials. For example, the sludge may contain from about 40 to about 94 percent, by weight, low-average fiber length pulp, and from more than about 6 to about 60 percent, by weight, ash generating materials. As another example, the sludge may contain from about 50 to about 85 percent, by weight, low-average fiber length pulp, and from about 15 to about 50 percent, by weight, ash generating materials.

In the practice of the present invention, the paper-making sludge is pulped using conventional pulping equipment. For example, paper-making sludge was placed in a pulping tank. Desirably, a pulping tank such as a "slush maker" available from the Morden Machine Company, Portland, Oreg. may by used.

The paper-making sludge is agitated with water to make a mixture. A mixture of about 4 percent solids content was found to be satisfactory although higher or lower solids content may be used. For example, paper-making sludge solids content may readily range from about 2 to about 8 percent. Pulping times generally run higher for paper-making sludges having substantially more low-average fiber length pulp than ash-generating solids. For example, a paper-making sludge containing about 17 percent, by weight, ash-generating solids had a pulping time of about 45 minutes. This stands in contrast to an exemplary paper-making sludge containing about 53 percent, by weight, ash-generating solids which had a pulping time of about 10 minutes under similar conditions.

The paper-making sludge pulp can be diluted to a consistency at or about the more concentrated end of conventional paper-making processes. For example, a consistency of about 1.25 percent solids maintained in a stirred tank (e.g., a paper-making machine chest) was found to be satisfactory. It is contemplated that consistencies of greater than about 1.25 percent solids may be used satisfactorily.

At this stage, it is desirable to incorporate one or more additives into the paper-making sludge pulp. For example, wet-strength additives may be added to enhance the integrity and handling of the newly formed paper-making sludge sheet. Additives to control the pH of the paper-making sludge substrate may be needed since a variety of destabilizing materials could be present in paper-making sludge. Sizing may be added to aid various properties (e.g., water repellency) of the paper-making sludge substrate. It is contemplated that cross-linking agents and/or hydrating agents may also be added to the paper-making sludge pulp. As an example, wet-strength resins such as Kymene wet-strength resins available from Hercules, Inc. of Wilmington, Del. may be added at a rate of about 20 pounds per ton of paper-making sludge. Although the specific additives for pH control will vary depending on the paper-making sludge, it has been found that some paper-making sludges require additions of alum at a rate of about 4 pounds per ton. In addition, some paper-making sludges require the addition of sizing to aid in the various properties (e.g., water repellency) of the paper-making sludge substrate. For example, one useful sizing is Neuphor 635 size (Hercules, Inc., Wilmington, Del.) which was added at a rate of about 6 pounds per ton.

Desirably, each addition should be allowed to agitate for a short time before the next material was added. In some instances, an agitation time of about 10 minutes was satisfactory. When several materials are added, one useful order of addition is as follows: alum; sizing; and wet-strength resin.

The dilute suspension of the paper-making sludge can be supplied by a conventional head-box and deposited via a slice in a uniform dispersion onto a forming fabric of a conventional paper-making or wet-laying machine.

In one particular example, a suspension of paper-making sludge passed from a machine chest to a head box which was a flow spreader with a ¼ inch slice opening onto an Appleton wire 94 mesh forming fabric.

Generally speaking, a relatively fine mesh forming fabric is desirable due to the absence of any significant proportion of high-average fiber length pulp in the paper-making sludge suspension. Single ply and multi-ply mesh forming fabrics having relatively fine mesh sizes appear to work well. An example, a forming fabric having a mesh of greater than 90 was found to be satisfactory. Suitable forming fabrics include, for example, the Appleton wire 94 mesh forming fabric described above which is available from Albany International Corporation of Appleton, Wis.

After the suspension of paper-making sludge is deposited on the forming fabric, water is removed from the suspension to form a uniform layer of paper-making sludge. Water removal may be assisted with vacuum slots or other conventional water removal techniques so that the uniform layer of paper-making sludge forms a sheet of paper-making sludge.

If the sheet of paper-making sludge is weak, it is contemplated that the sheet may be reinforced with a small amount of long fibers or pulp having a low ash content (i.e., less than about 4 percent) that are either mixed in or layered on the sludge sheet using conventional paper-making techniques. If a layer of long fibers is used, the layer is desirably located between the forming fabric and the paper-making sludge to form a relatively two-sided sheet.

The sheet of paper-making sludge can then be transferred to a carrier felt. An exemplary carrier felt may be an Albany Duramesh carrier felt available from Albany International of Appleton, Wis. Transfer of the paper-making sludge sheet to the carrier felt maybe assisted by a conventional vacuum transfer box. In one example, a vacuum of about five inches of water was used to assist the transfer.

The paper-making sludge sheet or substrate may be dried utilizing a compressive or non-compressive drying process. Yankee dryer processes have been found to work particularly well. It is contemplated that drying processes which provide at least one hard, smooth surface in contact with the paper during drying will work well. For example, steam cans, hot calender rolls and the like are contemplated to work well. Desirably, the paper-making sludge substrate is machine glazed (i.e., passed over a polished heated roller) during the drying step to impart a smooth finish. Although the inventors should not be held to a particular theory of operation, it is thought that the low-average fiber length pulp and the ash-generating materials in the paper-making sludge pulp are molded and flattened by the hard, smooth surfaces during the drying operation.

In one embodiment of the invention, a paper-making sludge sheet was transferred to a Yankee dryer having a substantially smooth drying surface. A pressure roll was used to put the paper-making sludge sheet in contact with the smooth Yankee dryer surface. The roll pressure used was about 55 pounds per square inch (psi). The Yankee Dryer was operated at a steam pressure of about 40 psi to dry the paper-making sludge substrate.

Release agents and other treatments may be used as appropriate in the drying processes. For example, a release agent may be used on the Yankee dryer. One suitable release agent is Quaker 2006D available from Quaker Chemical Corp. of Pomona, Calif.

Paper-making sludge substrates produced as described should have at least one substantially smooth face. Generally speaking, smoothness is determined by a Parker Print-Surf smoothness tester. Desirably the paper-making sludge substrate will have at least one surface having a Parker Print-Surf smoothness value of less than about 4.75 microns. For example, at least one surface of the un-coated paper-making sludge substrate may have a Parker Print-Surf smoothness value of less than about 4.25 microns. As a further example, the un-coated paper-making sludge substrate may have at least one surface having a Parker Print-Surf smoothness value of less than about 3.75 microns.

Although the inventors should not be held to a particular theory of operation, it is believed that the combined effect of large amounts of both low-average fiber length pulp and ash-generating materials in the paper-making sludge help to provide at least one un-coated surface on the paper-making sludge substrate when processed as described above. Pulp having a relatively large proportion of fines (e.g., composing more than 40 percent of the cellulosic material) does not, by itself appear to provide the level of smoothness generated by the combination of a large proportion of fines and a relatively high level of ash-generating materials found in paper-making sludge. It appears that the combination of both materials (i.e., fines and ash-generating materials) are most effective at filling or minimizing very small voids, holes or other cavities at the face of the substrate to help provide a relatively smooth surface.

Figure 2:
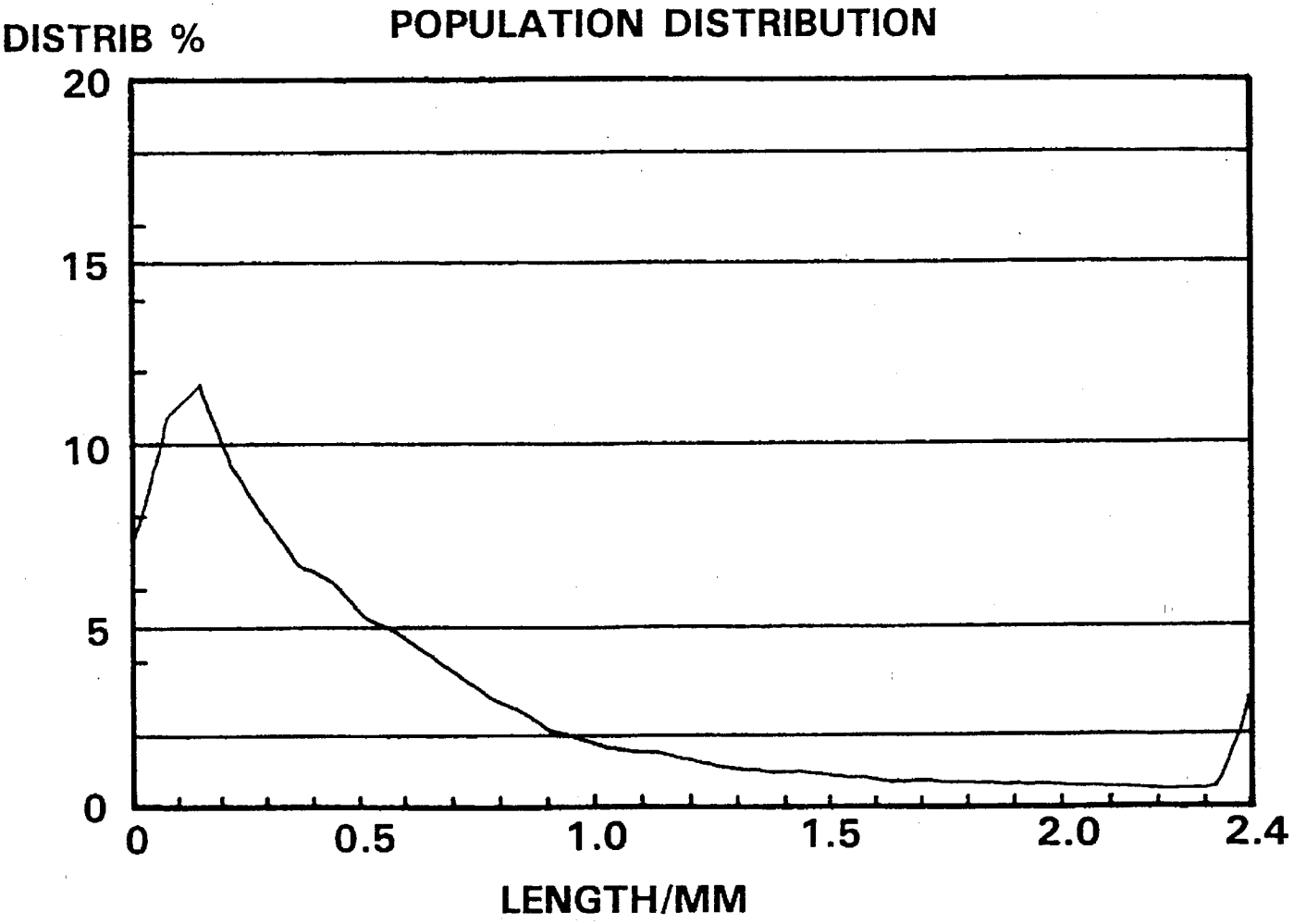
FIG. 2 is an illustration of a fiber population distribution for an for an exemplary paper-making sludge.

Referring to FIG. 1 of the drawings, there is shown an illustration of a fiber population distribution for an exemplary paper-making sludge. This particular paper-making sludge contained about 17.2 percent ash-generating materials as determined by conventional ash analysis of the sludge. FIG. 2 also depicts a fiber population distribution for an exemplary paper-making sludge. The particular paper-making sludge represented in the population distribution contained about 53.3 percent ash-generating materials as determined by conventional ash analysis of the sludge.

Figure 3:
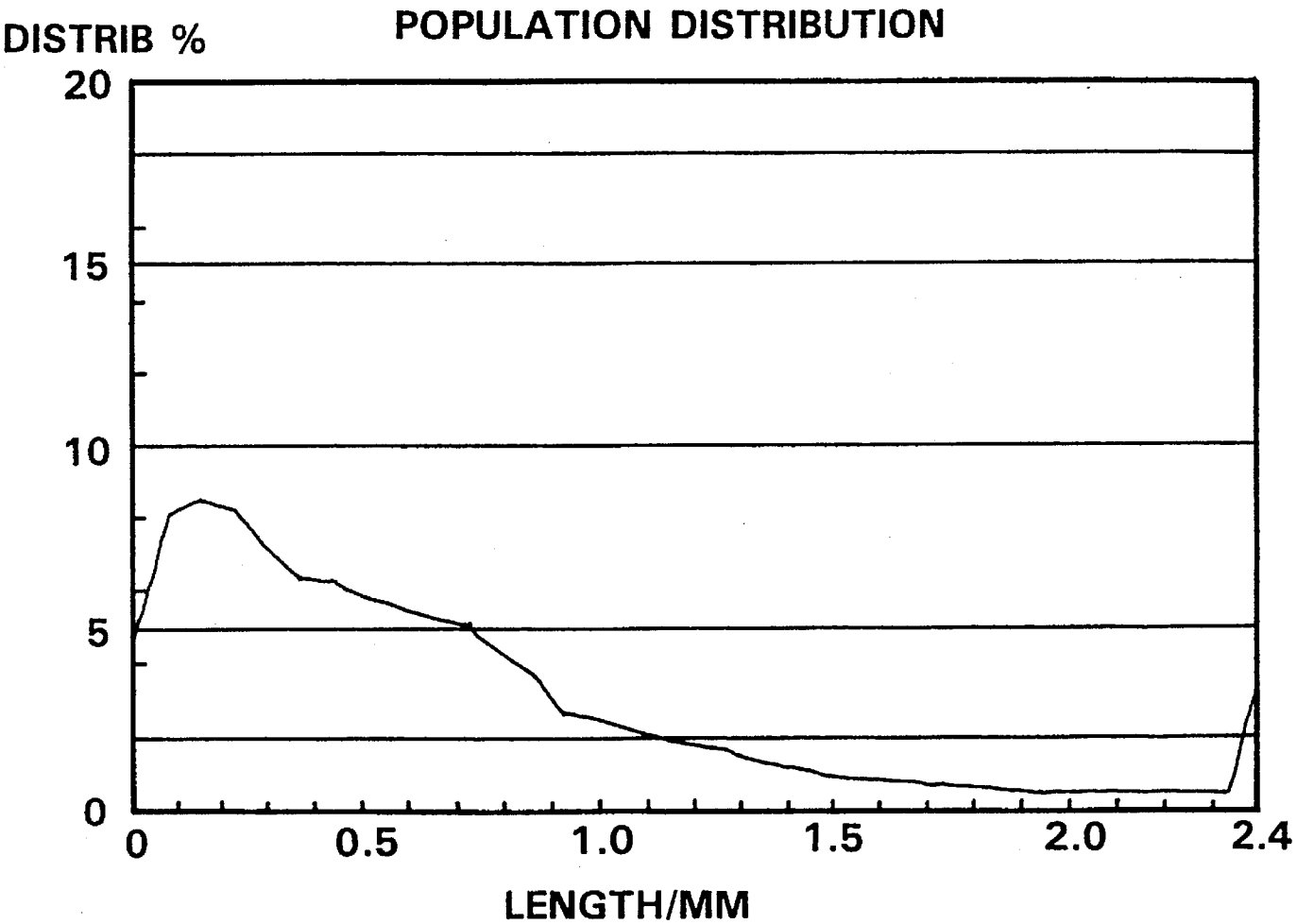
FIG. 3 is an illustration of a fiber population distribution for an for an exemplary recycled fiber pulp.

FIG. 3 is an illustration of a fiber population distribution for an exemplary recycled fiber pulp. As can be seen, the fiber population is not dramatically different from the fiber population distributions for the paper-making sludge samples. This particular recycled fiber pulp contained only about 1.22 percent ash-generating materials as determined by conventional ash analysis of a paper sheet made from the recycled fiber pulp.

When each of the paper-making sludges (FIGS. 1 & 2) were formed into substrates, they each had one surface having a Parker Print-Surf smoothness of less than 3.3 microns. On the other hand, the smoothest surface of a sheet made from the recycled fiber pulp (FIG. 3) had a Parker Print-Surf smoothness of about 5.3 microns.

The paper-making sludge substrate may be pre-treated before the metallizing step. For example, the paper-making sludge substrate may be calendered or super-calendered with a flat roll. It is contemplated that the paper-making sludge substrate may be texturized, creped, or patterned in order to achieve desired physical and/or textural characteristics. Additionally, at least a portion of the surface of the paper-making sludge substrate may be modified by various known surface modification techniques to alter the adhesion of the metallic coating to the paper-making sludge substrate. Exemplary surface modification techniques include, for example, chemical etching, chemical oxidation, ion bombardment, plasma treatments, flame treatments, heat treatments, and corona discharge treatments.

The paper-making sludge substrate produces a metallized paper having satisfactory gloss on at least one surface without the use of coatings commonly found in the paper industry. That is, the paper-making substrate may consist of or consist essentially of low-average fiber length pulp and ash-generating materials. It is contemplated that it may be desirable to apply a resin coating to enhance the gloss. Suitable resin coatings may include acrylic mixes or resins such as, for example, an acrylic mix having the trade designation FP3105 available from Cosh Industries of Folcroft, Pa.

Figure 4:
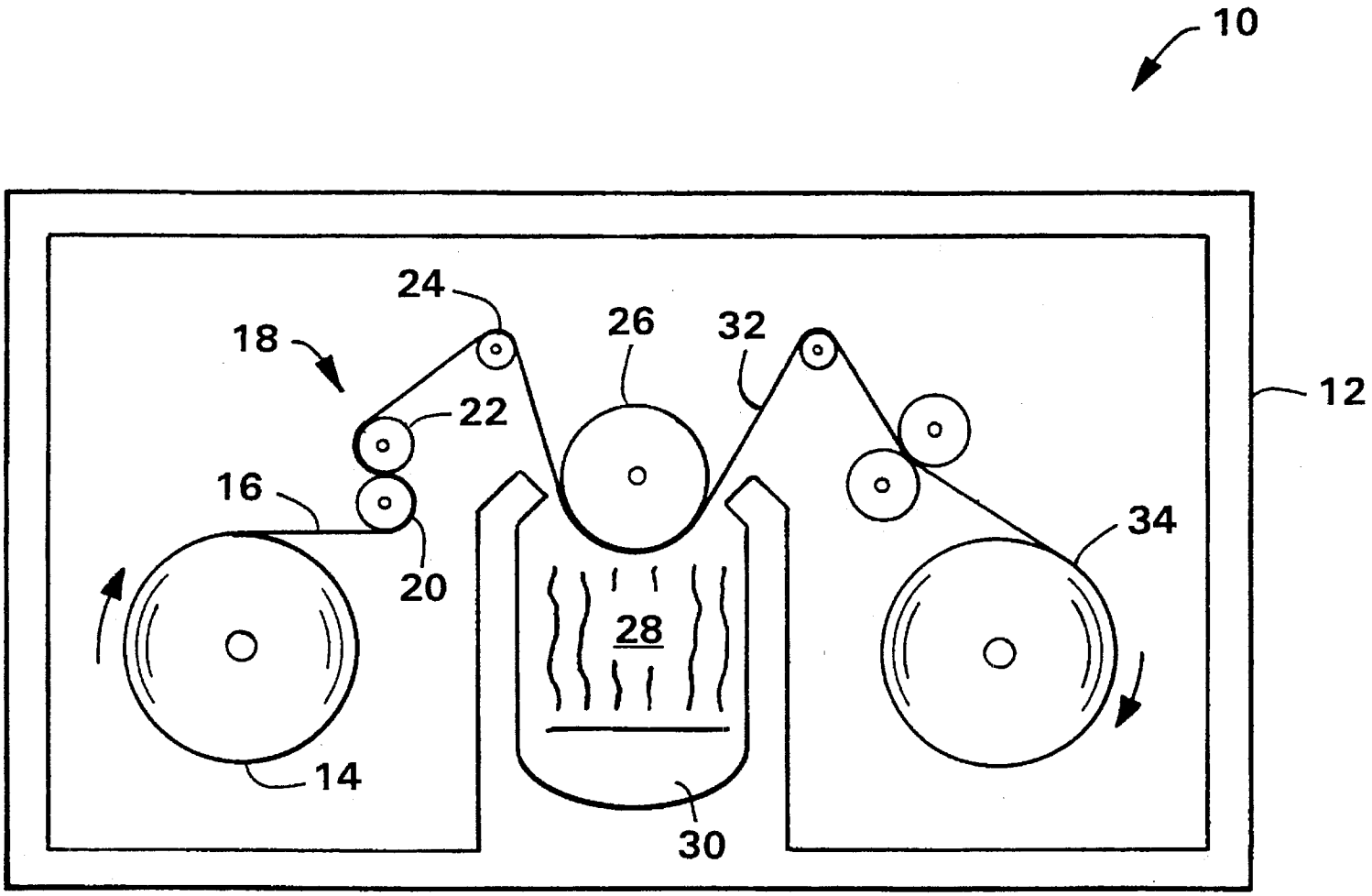
FIG. 4 is an illustration of an exemplary process for metallizing a paper-making sludge substrate.

Referring now to the drawings and in particular to FIG. 4, there is shown at 10 an exemplary process of making a metallized paper of the present invention within an evacuated chamber 12. Metal vapor deposition typically takes place in the evacuated chamber 12 at an absolute pressure from about $10^{-6}$ to about $10^{-4}$ millimeters Hg (mercury). A supply roll 14 of a paper-making sludge substrate 16 prepared as described above is located within the evacuated chamber 12. The supply roll 12 is unwound within the evacuated chamber 12 so that the surface of the paper-making sludge substrate 16 to be coated (e.g., a smooth surface) will be in the proper orientation during the process. The paper-making sludge substrate 16 travels in the direction indicated by the arrow associated therewith as the supply roll 14 rotates in the direction of the arrow associated therewith. The paper-making sludge substrate 16 passes through a nip of an S-roll arrangement 18 formed by two stack rollers 20 and 22. It is contemplated that the paper-making sludge substrate could be formed by paper-making processes and passed directly through the nip of the S-roll arrangement 18 without first being stored on a supply roll.

From the reverse S-path of the S-roll arrangement 18, the paper-making sludge substrate 16 passes over an idler roller 24 and then contacts a portion of a chill roll 26 while it is exposed to metal vapor 28 emanating from a molten metal bath 30. Metal vapor condenses on the paper-making sludge substrate 16 forming a metallized paper 32. Although a chill roll 26 is not required to practice the present invention, it has been found to be useful in some situations to avoid deterioration of the paper-making sludge substrate 16 during exposure to the metal vapor 28. For example, a chill roll would be desirable when the paper-making sludge substrate is exposed to the metal vapor for a relatively long period. Multiple metal baths and chill roll arrangements (not shown) may be used in series to apply multiple coatings of the same or different metals. Additionally, the present invention is meant to encompass other types of metallizing processes such as, for example, metal sputtering, electron beam metal vapor deposition and the like. Metal may also be deposited on the paper-making sludge substrate by means of a chemical reaction such as, for example, a chemical reduction reaction. Generally speaking, any process which deposits metal on the paper-making sludge substrate with minimal deterioration of the paper-making sludge may be employed. The metallizing processes described above may be used in combination in the practice of the present invention.

The metallic coating substantially covers at least a portion of at least one side of the paper-making sludge substrate 16. For example, the metallic coating may substantially cover all of one or both sides of the paper-making sludge substrate 16. The paper-making sludge substrate 16 may be masked with one or more patterns during exposure to the metal vapor 28 so that only desired portions of one or both sides of the paper-making sludge substrate have a metallic coating.

If desired, the paper-making sludge substrate 16 may be exposed to metal vapor 28 to deposit a first metallic coating on the paper-making sludge substrate 16. The fabric may then be exposed to metal vapor (from the same or a different molten metal bath) to deposit a second metallic coating. This step may be repeated any number of times with different combinations of elongations and molten metal baths to produce metallized papers having many different variations of metallic coatings.

After exposure to metal vapor 28, the metallized paper 32 is wound up on a winder 34.

Conventional fabric post-treatments may be applied to the metallized paper provided they do not harm the metallic coating. For example, shellacs or sizing may be applied.

The metallized paper may also be a multilayer material in that it may include two or more individual coherent paper layers, webs and/or films.

The basis weight of the paper-making sludge substrate may range from about 5 to about 170 grams per square meter. The basis weight may be selected to provide desired properties for the metallized paper, including flexibility and barrier properties. Desirably, the basis weight of the paper-making sludge substrate may range from about 30 to about 100 grams per square meter. Even more particularly, the basis weight of the metallized paper may range from about 35 to about 70 grams per square meter.

One important feature of the present invention is that the metallized paper (formed from the paper-making sludge substrate) is adapted to retain substantially all of its metallic coating. That is, there is little or no flaking or loss of metal observable to the unaided eye when a metallized paper of the present invention covered with at least at low to moderate levels of metallic coating is subjected to normal handling.

The thickness of the deposited metal depends on several factors including, for example, exposure time, the pressure inside the evacuated chamber, temperature of the molten metal, surface temperature of the fabric, size of the metal vapor "cloud", and the distance between the paper-making sludge substrate and molten metal bath, the number of passes over through the metal vapor "cloud", and the speed of the moving sheet of paper-making sludge substrate. Generally speaking, lower process speeds tend to correlate with heavier or thicker metallic coatings on the substrate, but lower speeds increase the exposure time to metal vapor under conditions which may deteriorate the paper-making sludge substrate. Under some process conditions, exposure times can be less than about 1 second, for example, less than about 0.75 seconds or even less than about 0.5 seconds. Generally speaking, any number of passes through the metal vapor "cloud" may be used to increase the thickness of the metallic coating.

The paper-making sludge substrate is generally metallized to a metal thickness ranging from about 1 nanometer to about 5 microns (μm). Desirably, the thickness of the metallic coating may range from about 5 nanometers to about 1 micron. More particularly, the thickness of the metallic coating may be from about 10 nanometers to about 500 nanometers.

Any metal which is suitable for physical vapor deposition or metal sputtering processes may be used to form metallic coatings on the elastomeric fabric. Exemplary metals include aluminum, copper, tin, zinc, lead, nickel, iron, gold, silver and the like. Exemplary metallic alloys include copper-based alloys (e.g., bronze, monel, cupro-nickel and aluminum-bronze); aluminum based alloys (aluminum-silicon, aluminum-iron, and their ternary relatives); titanium based alloys; and iron based alloys. Useful metallic alloys include magnetic materials (e.g., nickel-iron and aluminum-nickel-iron) and corrosion and/or abrasion resistant alloys.

EXAMPLES

The caliper or thickness of samples was determined essentially in accordance with TAPPI Standard T4110s-68 utilizing a Model 549 thickness tester available from TMI (Testing Machines Incorporated) of Amityville, N.Y. The thickness was measured using a flat ground circular pressure foot having an area of 200±5 mm that is lowered at a rate of 0.8 mm per second to exert a steady applied pressure of 0.50±0.01 kg/cm$^2$ for 3±1 seconds.

The basis weight of sample was determined essentially in accordance with ASTM D-3776-9. The density of the flat, generally planar samples was derived from measurements of thickness and basis weight of a sample.

Ash content was determined by igniting a pre-weighed sample (oven-dry weight) in a crucible placed in a muffle furnace maintained at 925° C. The contents of the crucible were kept at 925° C. for 1½ hours or until no black particles remain. Ash from the crucible was cooled to room temperature in a desiccator and immediately weighed. Ash content is calculated by dividing the weight of the dry ash by the oven dry weight of the sample and is expressed as a percentage.

Tensile testing was conducted with an Instron Model 1122 Universal Test Instrument in accordance with Method 5100 of Federal Test Method Standard No. 191A. "Stretch" refers to a ratio determined by measuring the difference between a samples initial unextended length and its extended length in a particular dimension and dividing that difference by the webs initial unextended length in that same dimension. This value is multiplied by 100 percent when elongation is expressed as a percent. The elongation was measured when the sample was stretched to about its breaking point.

Elmendorf Tear strength was measured using an Elmendorf Tear Tester, Model No. 60-100 essentially in accordance with TAPPI T414-Ts-65. Mullen Burst Strength was determined essentially in accordance with TAPPI Standard T-403 OS-74 using a Mullen Bursting Strength testing unit, motor driven, as supplied by B. F. Perkins & Sons, Holyoke, Mass. Parker Print-Surf smoothness was measured using a Parker Print-Surf roughness tester available from Messmer Instruments Limited of London, England.

The Frazier permeability was determined utilizing a Frazier Air Permeability Tester available from the Frazier Precision Instrument Company and measured in accordance with Federal Test Method 5450, Standard No. 191A, except that the sample size was 8"×8" instead of 7"×7. The Gurley porosity was determined utilizing a Gurley Densometer, Model 4190 equipped with elastic adapter gasket plate for porosity tests.

Substrates for Metallizing

Paper substrates and paper-making sludge substrates for metallizing were prepared from various pulps, paper-making sludges and sludge/pulp mixtures. Four basic materials were used. Two were paper-making sludges and two were recycled fiber pulps. Specific details about these four materials and sheets (e.g., papers or substrates) made from these materials are given in Table 1. It should be noted that the level of ash-generating material measured for particular sludges generally run higher than the levels of ash-generating material measured for sheets or papers made from the paper-making sludge. This phenomena is generally attributed to loss of ash-generating material by settling or washing during the sheet-forming (i.e., paper-making process). If desired, it is contemplated that suspension additives may be added to help enhance retention of ash-generating materials during the sheet-forming process thereby increasing levels of ash-generating material retained in the sheet.

The remaining samples were blends or combinations of the paper-making sludges and recycled fiber pulps listed in Table 1. The specific combinations and proportions of ingredients are given in Table 2.

Each sample was prepared using conventional paper-making equipment. The pulp, sludge or sludge/pulp mixture was placed in a tank (slush maker, Morden Machine Company, Portland, Oreg.) and agitated with water to make a mixture of 120 pounds of material at a 4 percent solids content. Pulping time for the various material is reported in Table 3. Two pulping times are reported for samples made from mixtures of paper-making sludge and recycled fiber pulp. Each material was pulped separately. The first reported number is the pulping time for the paper-making sludge, the second number is the pulping time for recycled fiber pulp.

Next, each pulp slurry was diluted to 1.25 percent solids in a stirred tank (machine chest). In this step, several materials are added. Kymene (Hercules, Inc., Wilmington, Del.) for wet strength. Alum for pH control and sizing for formation and sheet properties. Each addition was allowed to agitate for 10 minutes before the next material was added. The order of addition was alum, sizing, and Kymene. Table 4 lists the amounts of additives used with each sample.

From the machine chest, the solution was transported to a flow spreader with a ¼ inch slice opening and was deposited onto a forming fabric (Appleton wire 94 mesh, Albany International Corporation, Appleton, Wis.). The slurries were deposited using standard formation techniques. The forming mode for samples which contained only paper-making sludge or only recycled fiber pulp is identified in Table 4 as "Standard".

Blends of paper-making sludge and recycled fiber pulps were mixed after pulping in a separate tank and deposited through a single opening. The forming mode for samples made from blends of sludge and pulp is identified in Table 4 as "Blended".

Some samples were made using a layered formation (i.e., V-form) technique. In the V-forming mode, a separate sludge slurry and a separate recycled fiber pulp slurry were pumped to separate openings and deposited on separate forming fabrics. While still quite wet, one sheet (e.g., the recycled fiber pulp sheet) was removed from its forming fabric and deposited onto the other sheet (e.g., the paper-making sludge sheet) using a couch roll arrangement. The forming mode for these samples is identified in Table 4 as "V-form".

The resulting sheet was transferred to a carrier felt (Albany Duramesh, Albany International, Appleton, Wis.) utilizing a conventional vacuum transfer box. The vacuum was set at five inches of water.

The sheet was then introduced onto a Yankee Dryer. Dryer speed is reported in Table 3. A release agent was used on the dryer (Quaker 2006D, Quaker Chemical Corp., Ponoma, Calif.).

Properties of the samples made from combinations of paper-making sludge and recycled fiber pulp are reported in Table 5.

Comparative Examples

Three different conventional printed tissue papers and three different conventional wrapping papers were tested to measure strength, smoothness, permeability, ash and other characteristics. All the tissues and papers appeared to be heavily coated causing the densities to range from about 2 to about 3 times greater than the un-coated paper-making sludge substrates. The coatings also greatly reduced the permeability of the conventional materials. For example, the tissues and papers had Gurley porosity values ranging from about 4 to greater than 1800 sec/100 cc. In contrast, most of the paper-making sludge substrates had porosity values between about 0.6 and 3.3 sec/100 cc. One paper-making sludge substrate was tested at 12.6 sec/100 cc.

The printed tissues had ash levels ranging from about 0.75 to 5.93 percent and the wrapping papers had ash levels ranging from about 25.6 to 28.2 percent. It is believed that the relatively high ash levels (e.g., greater than about 2.5 percent) can be attributed to fillers, inks and other coatings deposited on the printed tissues and wrapping papers. For example, the printed wrapping papers appear to have a heavy coating of latex, $TiO_2$, coating clay and other materials. In marked contrast, the un-coated paper-making sludge substrates contain levels of ash-generating materials greater than 6 percent. It is thought that these high levels of ash-generating materials (in combination with a large proportion of low-average fiber length pulp) reduces or eliminates the need for large amounts of additional coatings, fillers and the like to produce a satisfactory substrate for metallization.

Metallized Paper

Metallization of paper substrates, paper-making sludge substrates and sludge/pulp substrates was done at Comvac America, Inc., Morristown, Tenn. Samples were placed in an Edwards Ltd., E306A metal coating unit available from Edwards Ltd., of Wilmington, Mass. The unit was operated at a vacuum of about $10^{-2}$ torr and an aluminum welding (99.88 percent purity) was the source of the metal for coating. Samples were kept in the coating unit long enough to deposit a metal coating of about ¼ micron on both sides. The approximate thickness of each coating was confirmed by subsequent observation using a JEOL 1200EX transmission electron microscope. Good quality metallizing was achieved on all samples. Samples could be characterized as having a relatively dull side and a relatively bright side.

It is thought that the metallized paper-making sludge substrates have substantially the same physical characteristics as the un-coated substrates because the metallic coating (i.e., ~¼ micron) is small compared to the paper thickness (e.g., 61 to 102 microns).

Brightness was measured using a D40 Gloss Sensor available from Hunter Associates of Reston, Va. The Gloss Sensor measurements were made at a reflective angle of 75°. Brightness data is contained in Table 7.

As can be seen in Table 7, the metallized (un-coated) paper-making sludge substrate LKV and the metallized (un-coated) paper-making sludge/recycled fiber pulp blend LOB-2 to produced at least one side which has a gloss that was 10 to 15 percent greater than the recycled fiber paper NEWS and even greater than the recycled fiber paper OCC.

The metallized (un-coated) paper-making sludge/recycled fiber pulp layered or V-formed material had lower gloss values. This can be attributed to the position of the material during the smoothing or glazing step. In these particular samples, the smooth (e.g., machine glazed) side was the recycled fiber pulp side and not the paper-making sludge side of the sheet. Because of the layered construction of samples LOV and LOV-2, it appears that sufficient amounts of ash-generating materials and low-average fiber length pulp (and "fines") were not able to migrate or be present at the face of the material during smoothing or glazing step.

It is expected that satisfactory levels of gloss would be achieved if the paper-making sludge side of the sheet was smoothed or glazed. This stands in contrast to sample LKV which was formed from sludge and LOB-2 which was a sludge/pulp blend. The LKV and LOB-2 samples appeared to have sufficient amounts of ash-generating materials and low-average fiber length pulp (and "fines") present at the face of the material during the smoothing or glazing step. The result was satisfactory levels of gloss.

One metallized (un-coated) paper-making sludge substrate HKB had relatively low levels of gloss. The substrate itself achieved good levels of smoothness as measured by the Parker Print-Surf test. Deposition of a metallic coating did produce a sufficiently glossy material. It is possible that materials in the sludge may have affected the metallic coating. It is also possible that better levels of gloss could be achieved by a slightly thicker metallic coating.

Disclosure of the presently preferred embodiments and examples of the invention are intended to illustrate and not to limit the invention. It is understood that those of skill in the art should be capable of making numerous modifications without departing from the true spirit and scope of the invention.

TABLE 1

| Properties of Paper | (LKV) Sludge Paper | (HKV) Sludge Paper | (NEWS) Recycled Newsprint | (OCC) Old Crushed Corrugate |
|---|---|---|---|---|
| BW g/m$^2$ | 20.45 | 25.57 | 24.43 | 26.70 |
| Ash (%) | 12 | 33.6 | 2.34 | 1.22 |
| Caliper (μm) | 99 | 61 | 79 | 76 |
| Density (g/in) | 207 | 419 | 321 | 300 |
| MD Tensile (g/in) | 1138 | 793 | 1827 | 3166 |
| CD Tensile (g/in) | 815 | 481 | 1029 | 1326 |
| MD Stretch (%) | 1.4 | 0.9 | 1.2 | 1.8 |
| CD Stretch (%) | 1.0 | 0.6 | 1.1 | 1.3 |
| Elmendorf Tear (g) | 16.0 | 12.0 | 4.8 | 25.6 |
| Burst (psi) | 3.63 | — | 3.90 | 6.10 |
| Gurley Porosity (sec/100 cc) | 1.2 | 0.9 | 1.6 | 0.3 |
| Fraz. Porosity (ft$^2$/min/ft$^2$) | 93.2 | 92.3 | 48.6 | 192.7 |
| PPS Smoothness (Microns) | | | | |
| Dry | 3.21 | 3.27 | 4.93 | 5.30 |
| Air | 6.91 | 7.19 | 6.79 | 7.79 |

TABLE 2

| Sample | Composition | |
|---|---|---|
| LOV | 50% OCC | 50% LKV |
| LOB | 50% OCC | 50% LKV |
| LOV-2 | 30% OCC | 70% LKV |
| LOB-2 | 30% OCC | 70% LKV |
| LNV | 50% NEWS | 50% LKV |
| LNB | 50% NEWS | 50% LKV |
| HOV | 50% OCC | 50% HKB |
| HOB | 50% OCC | 50% HKB |

TABLE 3

| Sample | Pulping Time (min) | Yankee Speed (fpm) |
|---|---|---|
| LKV | 45 | 40 |
| HKB | 10 | 25 |
| OCC | 60 | 60 |
| NEW | 60 | 60 |
| LOV | 45/60 | 60 |
| LOB | 45/60 | 60 |
| LNV | 45/60 | 60 |
| LNB | 45/60 | 40 |
| LOV-2 | 60/75 | 60 |
| LOB-2 | 60/75 | 40 |
| HOV | 10/75 | 50 |
| HOB | 10/75 | 40 |

TABLE 4

| Additive | LKV | OCC* | LOV | LOB | NEWS | LNV |
|---|---|---|---|---|---|---|
| Kymene-wet str. | 20#/ton | 20#/ton | 20#/ton | 20#/ton | 20#/ton | 20#/ton |
| Alum-pH & size | 4#/ton | 4#/ton | 4#/ton | 4#/ton | 4#/ton | 4#/ton |
| Neuphor 635-size | 6#/ton | 6#/ton | 6#/ton | 6#/ton | 6#/ton | 6#/ton |
| Hercon-AKD size | Standard | Standard | V-Form | Blended | Standard | V-Form |
| Forming Mode | | | | | | |
| **Additive** | **LNB** | **HKB** | **HOV** | **HOB** | **LOV-2** | **LOB-2** |
| Kymene-wet str. | 20#/ton | 10#/ton | 10#/ton | 10#/ton | 10#/ton | 10#/ton |
| Alum-pH & size | 4#/ton | 4#/ton | 4#/ton | 4#/ton | 12#/ton | 12#/ton |
| Neuphor 635-size | 6#/ton | 6#/ton | 6#/ton | 6#/ton | 6#/ton | 6#/ton |
| Hercon-AKD size | Blended | Standard | V-Form | Blended | V-Form | Blended |
| Forming Mode | | | | | | |

*Sulfuric Acid Added to OCC to drop pH to 6.2

TABLE 5

| Sample | BW (g/m) | Ash (%) | Caliper (μm) | Density (g/cm) | MD Tensile (g/in) | CD Tensile (g/in) |
|---|---|---|---|---|---|---|
| LOV | 28.69 | 6.68 | 97 | 296 | 2638 | 1382 |
| LOB | 27.27 | 6.93 | 102 | 267 | 2679 | 1292 |
| LOV-2 | 27.80 | 8.21 | 86 | 323 | 1843 | 1197 |
| LOB-2 | 28.16 | 8.36 | 84 | 336 | 2484 | 1307 |
| LNV | 28.69 | 6.33 | 79 | 363 | 2556 | 1320 |
| LNB | 28.13 | 8.69 | 102 | 276 | 2237 | 1114 |
| HOV | 30.43 | 16.3 | 84 | 362 | 2082 | 987 |
| HOB | 25.60 | 10.3 | 76 | 337 | 2082 | 958 |

| Sample | MD Stretch % | CD Stretch % | Elm. Tear (g) | Burst (psi) | PPS Smoothness (μm) Dryer | PPS Smoothness (μm) Air | Gurley Poro. (sec/100 cc) | Fraz. Poro. ($ft^3min/ft^2$) |
|---|---|---|---|---|---|---|---|---|
| LOV | 2.0 | 1.6 | 24.0 | 6.14 | 5.63 | 7.67 | 0.6 | 133.3 |
| LOB | 1.6 | 1.1 | 23.6 | 5.49 | 3.70 | 7.55 | 1.7 | 49.4 |
| LOV-2 | 1.6 | 1.8 | 21.2 | 5.17 | 5.51 | 7.50 | 0.7 | 95.1 |
| LOB-2 | 1.7 | 1.1 | 30.4 | 5.63 | 4.09 | 7.40 | 3.3 | 25.9 |
| LNV | 1.5 | 1.1 | 23.6 | 5.21 | 4.65 | 7.32 | 1.2 | 18.9 |
| LNB | 1.8 | 1.5 | 20.4 | 5.25 | 4.06 | 7.37 | 12.6 | 54.0 |
| HOV | 1.7 | 1.3 | 25.6 | 4.10 | 5.51 | 7.66 | 0.7 | 102.4 |
| HOB | 1.5 | 1.1 | 51.2 | 3.70 | 4.69 | 7.40 | 0.8 | 94.9 |

TABLE 6

| Sample | BW (g/m) | Ash (%) | Caliper (μm) | Density (g/cm) | MD Tensile (g/in) | CD Tensile (g/in) |
|---|---|---|---|---|---|---|
| Paisley Tissue | 22.78 | 2.46 | 36 | 641 | 3474 | NA |
| Multi Tissue | 22.26 | 5.93 | 38 | 584 | 3103 | NA |
| Dark Tissue | 21.69 | 0.76 | 36 | 810 | 1551 | NA |
| Balloon Wrap | 62.55 | 25.60 | 58 | 1115 | 9426 | 1926 |
| Pink Wrap | 61.16 | 27.70 | 61 | 1004 | 7539 | 2676 |
| Brown Wrap | 59.42 | 28.20 | 53 | 1017 | 6133 | 2506 |

| Sample | MD Stretch % | CD Stretch % | Elm. Tear (g) | Burst (psi) | PPS Smoothness (μm) Print | PPS Smoothness (μm) Back | Gurley Poro. (sec/100 cc) |
|---|---|---|---|---|---|---|---|
| Paisley Tissue | 1.10 | NA | 10.4 | 9.30 | 5.37 | 3.87 | 6.5 |
| Multi Tissue | .33 | NA | 11.2 | 7.70 | 2.75 | 6.14 | 21.3 |
| Dark Tissue | .35 | NA | 6.8 | 6.70 | 2.43 | 6.35 | 3.9 |
| Balloon Wrap | .13 | 1.68 | 26.4 | 13.80 | 2.32 | 1.83 | 1800+ |
| Pink Wrap | 1.29 | 2.33 | 21.2 | 13.90 | 2.15 | 1.62 | 1800+ |
| Brown Wrap | 1.27 | 3.40 | 25.2 | 12.30 | 1.65 | 1.53 | 1800+ |

NOTES:
Basis weight and ash values include coating as well as base-sheet CD tensiles could not be determined due to folds on tissue papers
The higher the Gurley seconds, the less porous the base-sheet
The lower the Parker Print-Surf value (PPS value), the smoother the base-sheet

TABLE 7

| Sample | Gloss Value Smooth | Gloss Value Rough |
|---|---|---|
| LOV | 17 | 5 |
| NEWS | 20 | 5 |
| OCC | 15 | 7 |
| HKB | 15 | 4 |
| LKV | 23 | 6 |
| LOV-2 | 13 | 5 |
| LOB-2 | 22 | 6 |

What is claimed is:

1. A metallized paper comprising: an un-coated dry substrate formed from paper-making sludge, the substrate having a first surface and second surface and consisting essentially of low-average fiber length pulp to about 60 percent, by weight; and a layer of deposited metal on at least one surface of the substrate, wherein at least one surface of the metallized paper has a gloss of at least about 19.

2. The metallized paper of claim 1, wherein at least one surface of the metallized paper has a gloss of at least about 20.

3. The metallized paper of claim 1, wherein at least one surface of the metallized paper has a gloss at least about 10 percent greater than a metallized un-coated paper composed substantially of pulp fibers having an ash content of less than 6 percent and having an identical metallic coating.

4. The metallized paper of claim 1, wherein at least one surface of the metallized paper has a gloss at least about 15 percent greater than a metallized un-coated paper composed substantially of pulp fibers having an ash content of less than 6 percent and having an identical metallic coating.

5. The metallized paper of claim 1, wherein the un-coated dry substrate formed from paper-making sludge has at least one surface having a Parker Print-Surf smoothness value of less than about 4.75 microns prior to metallization.

6. The metallized paper of claim 1, wherein the un-coated dry substrate formed from paper-making sludge has at least one surface having a Parker Print-Surf smoothness value of less than about 4.25 microns prior to metallization.

7. The metallized paper of claim 1, wherein the un-coated dry substrate formed from paper-making sludge has at least one surface having a Parker Print-Surf smoothness value of less than about 3.75 microns prior to metallization.

8. A multilayer material comprising at least two layers of the metallized paper according to claim 1.

9. A multilayer material comprising at least one layer of the metallized paper according to claim 1 and at least one other layer.

10. The multilayer material of claim 9 wherein the other layer is selected from the group consisting of papers, films, woven fabrics, knit fabrics, bonded carded webs, continuous spunbond filament webs, meltblown fiber webs, and combinations thereof.

11. A metallized paper comprising:

an un-coated dry substrate formed from paper-making sludge, the substrate having a first surface and second surface, at least one of which having a Parker Print-Surf smoothness value of less than about 4.75 microns, and consisting of low-average fiber length pulp having an ash content from about 6 to about 60 percent, by weight; and a layer of deposited metal on at least one surface of the substrate, the layer of metal having a thickness ranging from about 1 nanometer to about 5 microns, wherein at least one surface of the metallized paper has a gloss of at least about 19.

12. The metallized paper of claim 11, wherein at least one surface of the metallized paper has a gloss of at least about 20.

13. The metallized paper of claim 11, wherein at least one surface of the metallized paper has a gloss at least about 10 percent greater than a metallized un-coated paper composed substantially of pulp fibers having an ash content of less than 6 percent and having an identical metallic coating.

14. The metallized paper of claim 11, wherein at least one surface of the metallized paper has a gloss at least about 15 percent greater than a metallized un-coated paper composed substantially of pulp fibers having an ash content of less than 6 percent and having an identical metallic coating.

15. The metallized paper of claim 11, wherein the un-coated dry substrate formed from paper-making sludge has at least one surface having a Parker Print-Surf smoothness value of less than about 4.25 microns prior to metallization.

16. The metallized paper of claim 11, wherein the uncoated dry substrate formed from paper-making sludge has at least one surface having a Parker Print-Surf smoothness value of less than about 3.75 microns prior to metallization.

17. The metallized paper of claim 11, wherein the layer of metal having a thickness ranging from about 10 nanometers to about 500 nanometers.

18. A multilayer material comprising at least two layers of the metallized paper according to claim 11.

19. A multilayer material comprising at least one layer of the metallized paper according to claim 11 and at least one other layer.

20. The multilayer material of claim 19 wherein the other layer is selected from the group consisting of papers, films, woven fabrics, knit fabrics, bonded carded webs, continuous spunbond filament webs, meltblown fiber webs, and combinations thereof.

* * * * *